United States Patent [19]

Smith et al.

[11] 4,132,757

[45] Jan. 2, 1979

[54] TWIST EFFICIENCY OF OXADIAZOLE/HYDRAZIDE YARN

[75] Inventors: Andrew I. Smith; Wen-li Wu, both of Pensacola, Fla.

[73] Assignee: Monsanto Company, St. Louis, Mo.

[21] Appl. No.: 864,190

[22] Filed: Dec. 27, 1977

[51] Int. Cl.[2] ..... D01D 5/06

[52] U.S. Cl. ..... 264/210 F; 264/130; 264/184; 428/395

[58] Field of Search ..... 264/184, 210 F, 130, 264/136; 260/78 A; 428/395

[56] References Cited

U.S. PATENT DOCUMENTS

| | | | |
|---|---|---|---|
| 3,414,645 | 12/1968 | Morgan | 264/184 |
| 3,548,047 | 12/1970 | Jones et al. | 264/136 |
| 3,642,706 | 2/1972 | Morgan | 264/184 |
| 3,770,861 | 11/1973 | Hirano et al. | 264/130 |
| 3,796,693 | 3/1974 | Morgan et al. | 264/184 |
| 3,803,284 | 4/1974 | Burghardt et al. | 264/130 |

*Primary Examiner*—Jay H. Woo
*Attorney, Agent, or Firm*—John W. Whisler

[57] ABSTRACT

Yarns of phenylene oxadiazole/N-alkylhydrazide copolymers are made by a wet spinning process involving the steps of extruding, coagulating, washing, drying, hot-drawing and collecting. These yarns when formed into cord lose considerable tenacity, that is, cords plied from these yarns have considerably less tenacity than the individual yarns making up the cords. It has been found that this loss in tenacity in forming cords can be significantly reduced by applying a certain zirconium-containing finish to the yarn during its preparation. The finish is applied after the yarn is washed and while it is still wet.

10 Claims, No Drawings

TWIST EFFICIENCY OF OXADIAZOLE/HYDRAZIDE YARN

BACKGROUND OF THE INVENTION

A. Field of the Invention

This invention relates to the wet spinning process for producing yarn of copolymers consisting essentially of recurring units of the formulas

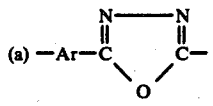

and

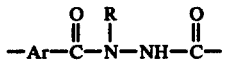

where Ar is

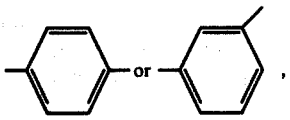

R is a $C_1$ to $C_4$ alkyl and the mole ratio of (a) units to (b) units is between 20:80 and 95:5. More specifically, the invention relates to the improvement of applying a certain zirconium-containing finish to the yarn during the wet spinning process whereby the twist efficiency of such yarn is significantly increased. The term "twist efficiency", as used herein means the ratio, expressed as a percentage, of the tenacity of a cord plied from strands of a given yarn to the tenacity of a single strand of the yarn, i.e.

$$\frac{\text{cord tenacity}}{\text{yarn tenacity}} \times 100.$$

The terms "O/H COPOLYMER", "O/H YARN" and "O/H CORD" are used herein to refer to the above-described copolymer, yarn thereof, and cord formed from yarn thereof, respectively.

B. Description of the Prior Art

There is a continuing demand in the tire industry for the development of a higher tenacity cord for use in the carcass of a tire. Yarns of organic polymers (e.g. nylons and polyester) are presently used in forming carcass cords. The cords are formed by plying two or more twisted strands of the yarn to provide a highly twisted configuration having tenacities in the 7 to 10 grams per denier range; the highly twisted configuration of the cords is necessary for good fatigue resistance properties. O/H YARN has a relatively high tenacity when compared to that of either nylon or polyester yarn. However, cord formed from twisted strands of O/H YARN although having good fatigue resistance has a much lower tenacity than expected due to the poor twist efficiency of O/H YARN. Normally, yarns have twist efficiencies of at least 65% (nylon 66 is $\geqq$ 72%), whereas in the case of O/H YARN its twist efficiency is $\leqq$ 50%.

Accordingly, it is an object of this invention to increase the twist efficiency of O/H YARN.

Another object of the invention is to provide a high tenacity cord suitable for use in the carcass of tires.

Other objects and advantages of the invention will become apparent from the following detailed description thereof.

SUMMARY OF THE INVENTION

In general, the objects of the invention are accomplished by applying a certain zirconium-containing finish to O/H YARN during the production thereof. More specifically, the invention relates to an improvement in the wet spinning process for producing O/H YARN whereby the twist efficiency of the yarn is increased. In carrying out the wet spinning process a sulfuric acid polymer solution (i.e. dope) is extruded through orifices of a spinneret into an aqueous coagulation bath to form filaments which are washed free or substantially free of sulfuric acid, dried, hot-drawn at a temperature between about 200° and 500° C. and collected. The improvement of this invention comprises applying to the yarn after the yarn is washed and prior to the yarn being hot-drawn a finish comprising a stable aqueous emulsion of at least one polyalkoxylated silicone oil and at least one dissolved water-soluble zirconium salt. Preferably, the finish is applied to the yarn between the washing and drying steps of the process while the yarn is still wet.

The term "silicone oil" is used herein in accordance with conventional terminology. The term "polyalkoxylated silicone oil", as used herein, means a silicone oil having sufficient structural groups of the formula (R—O) where R is a $C_2$ to $C_4$ alkylene, for example $-CH_2CH_2-$,

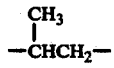

or $-CH_2CH_2CH_2-$ to render the oil capable for forming stable emulsions with water. The groups may be chain extended groups and/or appendent to a Si atom of the chain. Preferred polyalkoxylated silicone oils for use in practicing this invention have a molecular weight ranging from about 2000 to 120,000 and higher, with the higher molecular weight and more highly alkoxylated oils being particularly preferred. In addition to the polyalkoxylated silicone oil(s), the finish may also contain one or more silicone oils.

It is believed that the improvement in the twist efficiency of O/H YARN obtained by practicing the present invention is due in part at least to the fact that when zirconium is present in the finish the resulting hot-drawn yarn has better filament separation (i.e. less fusion of the filaments) than when the zirconium is omitted from the finish. It is further believed that better filament separation permits the individual filaments of the yarn to move more freely inside cord plied therefrom and thereby more evenly distribute the load on the cord throughout the individual filaments. It is therefore important that the zirconium remain in the finish and that the liquid components of the finish do not separate. In this regard the polyalkoxylated silicone oils is an essential component of the finish. The polyalkoxylated silicone oil component, in addition to being a lubricant for the yarn, forms stable emulsions with water and also ties up the zirconium by some mechanism (most likely by chelation or reaction) and thereby prevents zirconium from becoming ineffective such as would result if the zirconium were to migrate to the inside of the fiber.

The O/H YARNS to which a finish has been applied in accordance with the present invention have good tensile properties and good adhesion-to-rubber characteristics and, therefore, are particularly useful in forming cords for reinforcing flexible rubber articles such as tires and belts.

DETAILED DESCRIPTION OF THE PREFERRED EMBODIMENTS

Finishes useful in practicing the present invention comprise three components: water, water-soluble zirconium salt(s) and polyalkoxylated silicone oil(s).

Any water-soluble zirconium salt may be used in formulating the finishes. Representative such salts include the acetate, bromide, chloride, oxalate and sulfate of zirconium and ammonium zirconium carbonate with zirconium acetate being preferred. The amount of zirconium present in the finishes may range from 0.001% to about 10% by weight, based on the weight of silicone oil, with a range of between about 0.005 and 5% normally providing satisfactory results.

Any polyalkoxylated silicone oil may be used in formulating the finishes which forms a stable emulsion with water. Suitable polyalkoxylated silicone oils are commercially available and include, for example, silicone oils of the formulas:

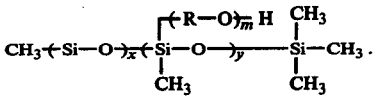

where R is a $C_2$ to $C_4$ alkylene, for example, ethylene or propylene and m, n, x and y are integers.

In addition to the polyalkoxylated silicone oil(s), the finish may also contain one or more silicone oils, such as polysiloxanes of the formulas:

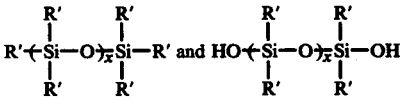

where R′ is alkyl or phenyl, with not more than one R′ on each Si atom being phenyl, and x is a whole number. Such polysiloxanes include those consisting essentially of phenylmethyl groups

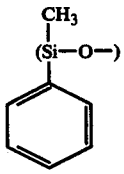

and dimethyl groups

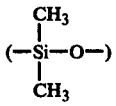

in a 30:70 to 95:5 ratio, respectively.

The finish may be prepared by combining the components in a conventional manner, for example, by dissolving the zirconium salt(s) in water, adding the water to the oil or blend of oils (or vice versa) and then sufficiently mixing the components to obtain a stable emulsion. The water serves to dilute the oil(s) and to facilitate accurate metering of the other components onto the yarn. Also, the water cleanly vaporizes from the yarn during drying of the yarn. From 01. to 25% by weight of the silicone oil component has been found to produce satisfactory results. The exact amount of polyalkoxylated silicone oil and water to be used in formulating the finishes will be apparent to a skilled practitioner and will depend on such factors as the rate at which the finish is applied to the yarn.

The finish may be applied to the yarn by conventional techniques such as by passing the yarn through a bath containing the finish or by using rolls which transfer the same from the bath to the yarn. Normally, the amount of oil(s) applied to the yarn may range from about 0.1 to about 10%, based on the weight of yarn, with a range of from about 0.5 to about 3% normally providing satisfactory results. The amount of zirconium applied to the yarn may range from 0.001 to about 2% by weight, based on the weight on yarn, with a range of 0.005 to 1% usually providing satisfactory results. While greater amounts of zirconium can be applied to the yarn, such amounts are not economically warranted. Preferably, the finish is applied to the wet yarn before the yarn is dried so that the water is vaporized from the yarn during the drying step.

The following examples are given to further illustrate the invention wherein, unless otherwise specified, percentages and parts are by weight.

In the examples O/H YARNS are produced by a wet spinning process wherein a sulfuric acid dope is extruded through orifices of a spinneret into an aqueous medium such as water or dilute sulfuric acid maintained at a temperature between 0° C. and 95° C. with ambient temperature being preferred. The spinneret may be immersed in the medium but is preferably positioned a short distance (0.32 to 5.1 cm) above the medium. The filaments formed in the medium are converged to form a yarn, withdrawn from the medium and thoroughly washed with water alone or combinations of alkaline solution and water to remove $H_2SO_4$ therefrom. After the washing step, a finish is applied to the yarn while it is still wet and, then the yarn is dried, such as by passing the yarn over a heated roll or pair of heated rolls (110°-140° C.). After the yarn is dried, the yarn is hot-drawn at a temperature between about 200° and 500° C. in a conventional manner. The hot-drawing of the yarn may be accomplished by continuously advancing the yarn through a zone in which the yarn is heated and drawn several times its length (i.e. 1 to 30 times its length). The yarn is then taken up (e.g. wound onto a bobbin). The yarn may be heated by passing it through a heated environment, e.g. through an oven heated by conventional means such as by infrared lamps, electricity, etc., or by passing the yarn over a heated surface, generally convex in shape, such as a hot shoe. The yarn is hot-drawn or stretched in the heated zone by withdrawing the yarn at a speed ($V_2$) greater than the speed ($V_1$) at which the yarn is advanced into the heated zone. Normally, $V_2$ represents the speed at which the yarn is collected. The draw ratio (DR) attained by the hot-draw step is conveniently expressed by $DR = V_2/V_1$. Normally, the tenacity of O/H YARN increases with increasing DR values. Where high tenacity O/H YARN is desired, it is a common practice to operate the process at the maximum draw ratio that can be utilized without frequently breaking the yarn, for example, at a DR equal to about 85% of $DR_b$, where $DR_b$ represents a draw ratio at which the yarn on the average will break.

The dope is prepared by reacting at a temperature between 80° and 170° C., preferably, at between 130° and 150° C. for from 4 to 6 hours, reactants consisting of (i) terephthalic acid (TA) and/or isophthalic acid (IA), (ii) the dialklester of TA and/or IA and (iii) hydrazine sulfate in oleum containing sufficient $SO_3$ to take up the water formed by the reaction. The mole ratio of reactants (i) to (ii) is from 95:5 to 20:80 with 40:60 to 60:40being preferred for high strength fiber applications. (iii) is present in a molar excess of a mole ratio of 1:1, (iii) to [(i) + (ii)], at least 0.5 mole %, for example, 0.8 to 4.0 mole % excess. The polymer of suitable fiber-forming molecular weight is normally formed in from 2 to 10 hours. Sufficient amounts of the reactants are used to provide a dope containing in solution from 1 to 15% by weight of polymer. A preferred dope is prepared from TA, the dimethyl ester of TA and hydrazine sulfate where the mole ratio of TA to the ester thereof is 1:1.

EXAMPLE 1

This example describes the preparation of an aqueous emulsion useful in practicing the present invention. Equal parts of an organopolysiloxane with dimethyl and phenylmethyl groups in a 50/50 ratio (obtained commercially from Dow Corning under the Tradename Dow Corning 550 Fluid) and of an organopolysiloxane (molecular weight ≈ 5000) having dimethyl and phenylmethyl groups and one polyethyleneoxide side chain (obtained commercially from Dow Corning under the Tradename Dow Corning FF-400) were mixed and warmed to 33° C. to form an oil blend. Deionized water was warmed to 33° C. and vigorously agitated while the oil blend was added thereto over a three minute period. After all of the oil blend was added to the water, agitation was continued for 10 minutes. The resulting emulsion contained 1 part of oil blend per 9 parts of water or 10% by weight of oil blend.

EXAMPLE 2

This example illustrates the substantial benefits gained by utilizing the improvement of the present invention in preparing yarn of O/H COPOLYMER consisting essentially of recurring units of the formula:

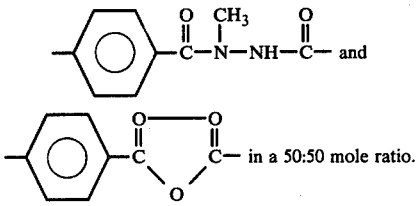

A spinning run was made in which O/H YARN of the above O/H COPOLYMER was prepared using substantially the procedure hereinabove described. Dope, obtained by polymerizing terephthalic acid, dimethylterephthalate and hydrazine sulfate in oleum, was extruded into aqueous sulfuric acid to form 20 filament yarn which was washed, neutralized, again washed, dried, hot-drawn at a draw ratio of 4.6 over a hot-shoe (384° C.) and wound onto a bobbin to provide a drawn yarn having a denier of between 20–23. During the spinning run 4 samples of yarn (2A–2D) were collected to which a silicone oil base finish was applied to each yarn between the washing and drying steps while the yarn was still wet. The finish applied to one yarn sample (2A) consisted of the emulsion described in Example 1 diluted 20 fold with deionized water. The finish applied to the other yarn samples consisted of the same diluted emulsion to which a specified amount of zirconium had been added. The zirconium was added by dissolving zirconium acetate in a portion of the deionized water used to dilute the oil blend.

Each yarn sample was cut into equal lengths and sufficient of the lengths were plied with 2 turns per inch (tpi) to provide a nominal 1300 denier yarn. Two equal lengths were then cut from this yarn. A right-hand twist of 11 tpi was imparted to each length of the 1500 denier yarn. Then, the two twisted yarns were plied with 11 tpi of left-hand twist to provide a 1500/2 11 × 11 tpi balanced tire cord. Cords prepared from yarn samples 2B-2D had good cord-to-rubber adhesion properties. The tenacity of each yarn and cord was determined in a conventional manner using an Instron Tester (Instron Engineering Corporation, Canton, Mass.) providing a constant extension rate of 10% per minute with a gauge length of 25 cm being used. The tenacities in grams per denier (gpd) of the yarns along with the amount of zirconium contained in the finish applied thereto and other data are given in the following Table. The tenacities given in the table represent the average of five determinations or breaks.

TABLE I

| Sample | Finish Wt. Oil Blend | % Zr | Yarn Denier | Yarn Tenacity | Cord Denier | Cord Tenacity |
|---|---|---|---|---|---|---|
| 2A | 0.5 | 0 | 1535 | 12.53 | 3514 | 6.95 |
| 2B | 0.5 | 0.0074 | 1541 | 13.23 | 3497 | 7.38 |
| 2C | 0.5 | 0.0148 | 1526 | 12.99 | 3470 | 6.99 |
| 2D | 0.5 | 0.0370 | 1532 | 13.39 | 3492 | 7.55 |

The results in Table I show that the addition of zirconium to a silicone base finish with other processing conditions being held constant provides cords of higher tenacity than when zirconium is omitted from the finish.

EXAMPLE 3

A silicone oil base finish diluted with water to provide a finish containing 2% by weight of oil blend was prepared using the same procedure as described in Example 1 except that, instead of using 1 part of Dow Corning 550 Fluid per part of Dow Corning FF-400, 3 parts of an organopoly-siloxane consisting of phenylmethyl and dimethyl groups in a 88.5/11.5 ratio (Dow Corning 710 Fluid) was used. To individual portions of this finish zirconium acetate and/or water was added in the same manner as set forth in Example 2 to prepare the following finishes:

| Finish | % Oil Blend | Zr |
|---|---|---|
| A | 2 | 0.06% |
| B | 2 | 0.03% |
| C | 2 | none |

Yarns and cords were made as described in Example 2 with one of the above finishes being applied to each of the yarns. Cords prepared from yarns to which Finish A and B were applied had good cord-to-rubber adhesion properties.

The tenacities of the resulting yarns and cords were determined and are given in the following table:

TABLE II

| Sample | Finish | Denier Yarn | Denier Cord | Tenacity(gpd) Yarn | Tenacity(gpd) Cord |
|---|---|---|---|---|---|
| 1 | C | 1566 | 3568 | 10.92 | 6.46 |
| 2 | B | 1575 | 3521 | 11.57 | 7.59 |
| 3 | A | 1481 | 3371 | 11.67 | 7.00 |
| 4 | C | 1561 | 3488 | 9.58 | 5.85 |
| 5 | A | 1571 | 3456 | 11.34 | 6.85 |

The results in Table II show that in each instance the addition of zirconium to the finish with all other processing variables being held constant provides cords having higher tenacities than when zirconium is omitted from the finish. Also, yarns to which zirconium was applied had noticeably better filament separation.

EXAMPLE 4

This example illustrates a preferred embodiment of the invention wherein the finish is prepared employing as the polyalkoxylated silicone oil a high molecular weight (approximately 100,000) hydroxyl end-blocked dimethyl polysiloxane of the formula:

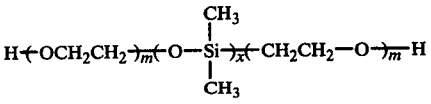

This silcone oil was obtained commercially from Dow Corning (DC-1111). Finishes containing varying amounts of this silicone oil, water and zirconium acetate were prepared and applied to yarn samples prepared as described in Example 2. Cords were prepared from the resulting yarn samples in the manner described in Example 2, except in this instance the cords were 1500/2 8 × 8 tpi instead of 1500/2 11 × 11 tpi. The tenacities (T) in grams per denier, elongation-to-break (E) in percentage and modulus (M) in grams per denier were determined for each yarn and cord and are given in Table III along with the amount of silicone oil, zirconium (Zr) and any other materials which were used in formulating the finishes. It will be understood that each finish consists of water plus the materials listed in the Table.

TABLE III

| Yarn Sample | Silicone Oil | Dispersion Agent | Zr | Yarn(2tpi) T/E/M | Cord |
|---|---|---|---|---|---|
| 1 | 1.0% | none | none | 17.3/6.5/323 | 10.8/8.8/214 |
| 2 | 1.0% | none | .03% | 17.4/6.7/319 | 11.7/8.8/213 |
| 3 | 1.0% | none | .06% | 16.9/6.3/203 | 11.0/8.1/139 |
| 4 | 1.0% | .2% FF400 | .03% | 15.1/6.3/276 | 12.1/8.7/209 |
| 5 | 1.0% | .2% FF400 | none | 14.9/6.3/275 | 11.4/8.9/204 |
| 6 | 1.0% | .3% FF400 | .03% | 14.2/6.1/267 | 11.4/8.2/201 |
| 7 | 1.0% | .2% Ethomeen | .03% | 15.9/6.3/305 | 12.4/8.4/244 |
| 8 | 1.0% | .2% Ethomeen* | none | 16.2/6.8/292 | 10.7/9.2/205 |

*Ethomeen - Trademark of Armour Industrial Chemical Company for polyethoxylated amines with alkyl groups ranging from $C_8$ to $C_{18}$.

The results in Table III show that cord formed from yarns prepared in accordance with the present invention have higher tenacities than corresponding yarns from which zirconium has been omitted from the finish. In samples 4–8 the finish contained a small amount of additional emulsifying agent.

We claim:

1. In the wet spinning process for producing yarns of a copolymer consisting essentially of recurring structural units of the formulas:

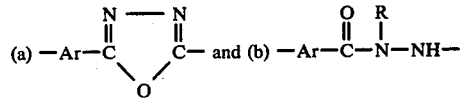

in a mole ratio of 20:80 to 95:5, respectively, where Ar is meta-phenylene or para-phenylene and R is a $C_1$ to $C_4$ alkyl, wherein a dope comprising copolymer in concentrated sulfuric acid is extruded into an aqueous coagulation medium to provide continuous filament yarn of said copolymer which is then washed, dried, hot-drawn at a temperature between about 200° C. and about 500° C. and collected, the improvement comprising applying to the yarn after washing and before drying thereof a finish comprising a stable aqueous emulsion of at least one silicone oil having structural groups of the formula —R—O— where R is a $C_2$ to $C_4$ alkylene and at least one dissolved water-soluble zirconium salt.

2. The process of claim 1 wherein said emulsion contains from 0.001% to 10% by weight of zirconium, based on the weight of said silicone oil.

3. The process of claim 1 wherein said emulsion contains from 0.01% to 25% by weight of said silicone oil.

4. The process of claim 1 wherein said silicone oil is of the formula

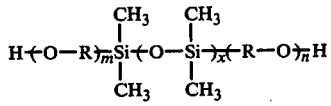

wherein R is a $C_2$ to $C_4$ alkylene and m, n and x are integers such that the oil forms stable emulsions with water.

5. The process of claim 1 wherein said silicone oil is of the formula

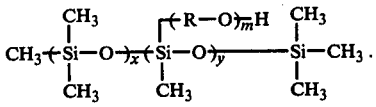

wherein R is a $C_2$ to $C_4$ alkylene and m, x and y are integers such that the oil forms stable emulsions with water.

6. The process of claim 1 wherein said emulsion contains as an additional component at least one polyorganosiloxane consisting essentially of recurring units of the formula

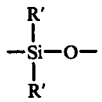

where each R′ is alkyl or phenyl with not more than one R′ on each Si atom being phenyl.

7. The process of claim 6 wherein said polyorganosiloxane consists essentially of recurring units of the formulas

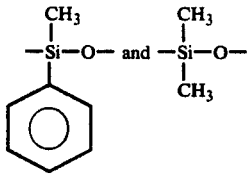

in a 30:70 to 95:5 ratio, respectively.

8. The process of claim 1 wherein said dope is prepared by reacting (i) terephthalic acid and/or isophthalic acid, (ii) the $C_1$ $C_4$ dialkylester of (i), and (iii) hydrazine sulfate in oleum containing sufficient $SO_3$ to take up water formed by the reaction, wherein the mole ratio of (i) to (ii) is from 95:5 to 20:80 and the mole ratio of (iii) to (i) + (ii) is from 1.005:1.000 to 1.04:1.00.

9. The process of claim 8 wherein the mole ratio of (i) to (ii) is from 40:60 to 60:40.

10. The process of claim 9 wherein (i) is terephthalic acid and (ii) is dimethylterephthalate.

* * * * *

UNITED STATES PATENT AND TRADEMARK OFFICE

CERTIFICATE OF CORRECTION

PATENT NO. : 4,132,757

DATED : January 2, 1979

INVENTOR(S) : Andrew I. Smith, Wen-li Wu

It is certified that error appears in the above-identified patent and that said Letters Patent are hereby corrected as shown below:

Column 1, line 20, insert -- (b) -- in front of formula.

Column 2, line 33, delete "(R-O)" and add -- $-(R-O)-$ --.

Column 3, line 30, insert the following:

$$\text{-- } H-(O-R)_m-\underset{\underset{CH_3}{|}}{\overset{\overset{CH_3}{|}}{Si}}-(O-\underset{\underset{CH_3}{|}}{\overset{\overset{CH_3}{|}}{Si}})_x-(R-O)_n-H \text{ and --}$$

Column 5, line 14, delete "60:40being" and insert -- 60:40 being --.

Column 6, line 44, delete "being" and insert -- be --.

Column 10, line 1, delete "$C_1C_4$" and insert -- $C_1$ to $C_4$ --.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*